US005083374A

United States Patent [19]

Miller

[11] Patent Number: 5,083,374

[45] Date of Patent: Jan. 28, 1992

[54] THERMALLY PRESTRESSED CYLINDRICAL STRUCTURE AND METHOD OF MAKING SAME

[76] Inventor: Ray R. Miller, 8816 Warren Dr., NW., Gig Harbor, Wash. 98335

[21] Appl. No.: 643,153

[22] Filed: Jan. 18, 1991

Related U.S. Application Data

[63] Continuation-in-part of Ser. No. 509,570, Apr. 16, 1990, abandoned, which is a continuation-in-part of Ser. No. 387,811, Aug. 1, 1989, abandoned.

[51] Int. Cl.[5] ..... B21B 13/02

[52] U.S. Cl. ..... 29/895.3; 29/110; 165/89

[58] Field of Search ..... 29/110, 895, 895.212, 29/895.3; 138/DIG. 5; 148/144, 148; 34/240; 165/89

[56] References Cited

U.S. PATENT DOCUMENTS 3,216,869 11/1965 Koistinen ..... 148/16.6
3,946,499 3/1976 Schiel ..... 34/124
4,710,271 12/1987 Miller ..... 162/360.1

FOREIGN PATENT DOCUMENTS 61-170516 8/1986 Japan .

OTHER PUBLICATIONS

Froehlich, C. H., N. G. Cofie and J. R. Sheffield, IHSI Proves Its Worth, *Nuclear Engineering International*, Jan., 1988, pp. 47–48.

Gordon, G. M. and W. D. Miller, Implementing IGSCC Countermeasures in the U.S.A.—A Progress Report, *Nuclear Engineering International*, Jan. 1988, pp. 44–46.

King, Reno C. *Piping Handbook*, 5th Ed., McGraw-Hill, New York (1967), pp. 7–136 and 7 ∝ 138.

Porowski, J. S., W. J. O'Donnell, M. L. Badlani and E. J. Hampton, Using MSIP (Mechanical Stress Improvement Process) to Inhibit Igscc., *Nuclear Engineering International*, Nov. 1986, pp. 56–58.

*Primary Examiner*—Joseph M. Gorski
*Assistant Examiner*—S. Thomas Hughes
*Attorney, Agent, or Firm*—Keith D. Gehr

[57] ABSTRACT

The invention is a method of prestressing a heat transfer cylinder by thermal means to create residual stresses which act to reduce the operating thermal stresses in the cylinder wall. The invention also includes a cylinder prestressed by the method. An example might be a cylindrical drum having a heat source adjacent its inner surface to be used for heating a material on its outer surface. The drum would be thermally prestressed to have residual compression stresses at its outer surface and residual tension stresses at its inner surface under conditions of no heat flow. These stresses are opposite in direction to those induced by heat flow through through the drum wall during operation.

8 Claims, 5 Drawing Sheets

AUTOFRETTAGE RESIDUAL STRESS

CASTING RESIDUAL STRESS

DIFFERENTIAL MARTENSITIC TRANSITION STRESS

YIELDING OF ANNEALED STEEL

GENERAL STRESS-STRAIN DIAGRAM

HEAT FLOW
STRESS DUE TO HEAT FLOW
YIELD STRESS IN TENSION
0 STRESS
YIELD STRESS IN COMPRESSION
ID
OD

NO HEAT FLOW
THEORETICAL RESIDUAL STRESS
TENSION STRESS
0 STRESS
COMPRESSION STRESS
ID
OD

RESIDUAL STRESS AFTER EQUALIZING
TENSION STRESS
0 STRESS
COMPRESSION STRESS
ID
OD

THERMALLY PRESTRESSED CYLINDRICAL STRUCTURE AND METHOD OF MAKING SAME

This application is a continuation-in-part of copending application Ser. No. 509,570, filed Apr. 16, 1990, which was a continuation-in-part of application Ser. No. 387,811, filed Aug. 1, 1989, both now abandoned.

BACKGROUND OF THE INVENTION

The present invention is a method and the resulting article produced by prestressing the wall of a cylindrical structure to be used for heating or cooling a material being processed on a surface of the structure. These stresses are opposite in direction to those introduced by heat flow through the drum wall when in use. An example might be an internally heated dryer drum or the drum of a drum-and-belt type press in which the outer surface is caused to have residual compression stresses and the inner surface residual tension stresses under conditions of no heat flow through the drum.

Many manufacturing processes require the simultaneous application of both heat and mechanical pressure to a continuously moving mass of material being processed. An example might be the drying of paper. In some instances a rotating heated drum applies both heat and pressure to the moving web of paper. Miller, in U.S. Pat. No. 4,710,271, shows a hollow cylindrical drum with an internal heat source and external rolling loads as an example of this type of operation.

The situation can readily arise in which the desired combination of heating loads through the drum wall, and the superimposed external mechanical loads, produce a combination of differential expansion, thermal stress, and mechanical bending stress which exceeds the allowable design stress of the drum material. An intrinsic dilemma for a designer is that increasing thermal flux requires a thinner drum wall to reduce temperature differential across the wall. However, increasing mechanical stress requires a thicker drum wall to bear the imposed loads.

It is well known that conventional paper drying cylinders remove 5 to 7 pounds of water per hour per square foot of dryer cylinder surface. This requires a heat flow through the cylinder surface of perhaps 10,000 BTU/hr/ft$^2$. In most cases there are only negligible mechanical forces acting on the outer circumference of the cylinder. However, a high performance paper dryer cylinder, such as that of U.S. Pat. No. 4,710,271, might require a heat flow through the cylinder wall of 100,000 BTU/hr/ft$^2$. It could also require large external mechanical loads, such as multiple nips, with each nip exceeding a loading of 1000 pounds per linear inch. The result is a very severe combination of thermal and mechanical loading. The problem of compensating for these operating stresses has not been satisfactorily addressed prior to the present invention.

In a long hollow thin wall cylinder, with heat flow from the inside to the outside, compression is induced at the hotter surface and tension at the cooler surface. The maximum circumferential stress S (compression at the hotter side, tension at the cooler side is $\frac{1}{2}\Delta T\ \alpha E/(1-\nu)$ where $\Delta T$ is the temperature difference from the hot to the cooler side, $\alpha$ is the coefficient of thermal expansion for the wall material, E is the modulus of elasticity and $\nu$ is Poission's ratio (Roark, R. J. and W. C. Young, *Formulas for Stress and Strain*, 5th ed., p 585, McGraw-Hill, New York, 1975). The stress so calculated will take the pattern of FIG. 1. Thermal flow in operation will produce a similar pattern of equal and opposite stresses (tension and compression) at the two surfaces. Thus, it is most desirable for a stress reducing mechanism to relieve the stresses at the surfaces in a manner similar to that in which they naturally occur.

Others have prestressed cylindrical objects for various purposes. However, none of these products have addressed the problems outlined above. As one example Schiel, in U.S. Pat. No. 3,946,499, preloads a cylindrical drum closed by end bells. This is done by means of a tensioned interior tie rod assembly affixed between the end bells. The stress imposed upon the wall is an axial compression load which is uniform across the wall thickness. The purpose of the preloading is to let the tie rod or rods bear the force of the internal steam pressure on the end bells instead of the cylinder wall. In concept Schiel is equivalent to a preloaded beam.

Autofrettage is the internal hydrostatic loading of a thickwalled tube, such as a cannon barrel, to create residual compression stresses at the inner surface. This produces an asymmetric stress pattern across the wall similar to that shown in FIG. 2.

Casting a metal object inherently creates residual shrinkage stresses in the casting. A cast hollow cylinder will have residual stresses due to a differential transition from the molten to the solid state. Assuming that the outer surfaces cools and solidifies before the interior mass of the wall, tension will be created in the interior portion and compression at the outer surface. The inner surface will have a smaller amount of tension or compression depending on respective cooling rates. As seen in FIG. 3, the stresses will not be equal at the two surfaces and the stress pattern does not vary evenly across the wall thickness.

Heat treating processes are frequently used, often based on the selection of specific metal alloys, to produce a certain stress pattern in a metal object. For example, Koistinen, in U.S. Pat. No. 3,216,839, teaches the creation of a residual compressive stress layer on the surface of an austenitic steel object. This is done by altering the transition of that layer to a martensitic structure. The transition form austenite to martensite causes a 3–4% increase in volume. By delaying the transition of the surface layer, upon its subsequent transition its volume increase is constrained by the already hardened bulk of the object. This constraint introduces residual compression stresses as shown in FIG. 4. Koistinen provides for altering the transition temperature of the layer either by changing its austenizing temperature, which changes its transition temperature to martensite, or by using a different alloy for the surface layer. In addition to the differences already noted, the Koistinen method requires that the quenching rate should be comparatively slow so that the smallest possible temperature gradient can be maintained between the inner core and the surface.

Japanese laid open application Sho 61[1986] 170516 teaches production of residual compression stresses in small localized areas of a pipe adjacent to disturbances such as a nipple location. A zone of tension stress surrounding the compressed area is produced incidental to production of the compressed area. At any given point the stress across the wall thickness is essentially uniform.

The above noted Japanese application rather vaguely mentions a prior art method which creates residual compression stress at the butt weld seam of a pipe. This procedure is used to avoid stress corrosion cracking in an environment where the following three essential elements all are present—a susceptible metal, tension stress, and a corrosive environment. The procedure is described in more detail in an article by Froelich et al., *Nuclear Engineering International*, January, 1988, pp 47–48. The process called induction heating stress improvement (IHSI) uses induction heating outside the pipe and a flow of cooling water inside the pipe to create a sufficient temperature differential across the wall so as to leave the desired residual compression stresses at the inside wall.

As will be pointed out in detail later, there are several very significant differences between IHSI and the present invention. The sole objective of IHSI is the creation of residual compression stresses adjacent the weld seam at the inside pipe wall surface. Any residual tensile stress created at the outside wall would be either incidental to the process or could actually be detrimental. Porowski et al., *Nuclear Engineering International*, November, 1986, pp 56–57, confirm that residual tension stresses on the outside of the pipe are undesirable. This group teaches the use of a mechanical method to induce compression at the inside wall surface. They state that thermal processes "leave high hoop residual tensile stresses in the outer half of the wall, allowing deep axial cracks and leaks".

It will be shown later that the present invention requires equal but opposite stresses at the surfaces. IHSI uses induction heating which inherently delivers heat to the interior portion of the wall as well as to the surface. King, in the *Piping Handbook*, 5th ed., pp 7–136 and 7–138, McGraw-Hill, New York (1967), discusses the use of induction heating for heat treatment of ferritic-steel pipe welds. He confirms that heating occurs within the wall so as to provide "more uniform temperature throughout the wall and a smaller temperature difference between the outside and inside surfaces". The context of the article is heat treatment for stress relief, not the creation of any specific stress pattern within the pipe wall. Nevertheless, application of heat in this manner would create a non-linear temperature differential across the wall thickness and would unavoidably create unbalanced stresses at the two surfaces. Depending on the particular operating conditions, the yield stress on the hot side might or might not be exceeded. In the later case, that would leave no residual tension stress at the outer surface and the stress pattern would resemble that shown in present FIG. 2. An unbalanced stress pattern of this or any other type is wholly unsatisfactory for the present invention.

For the above reasons, induction heating is generally not applicable to the present invention.

The current invention specifically addresses the problem of high thermal and mechanical loads on a cylindrical structure and provides a means for significantly reducing the contribution of thermal stress to the combined load while still permitting a high heat flux.

SUMMARY OF THE INVENTION

The present invention provides a method for reducing the stress effect of heat flow on the wall of a cylindrical structure by thermally prestressing the wall in a direction opposite to the thermal stress produced by the intended heat flow during operation. For convenience a dryer drum will be considered as being exemplary of the cylindrical structure of the invention. For purposes of explanation, it will also be assumed that the desired heat flow will be from inside the drum through the wall producing a temperature gradient or differential through the wall that creates a tension stress on the outer (cooler) wall surface and a compression stress on the inner (hotter) surface. However, it will be very evident that the invention is not limited to a structure or method of operation of this particular type. Alternatively, it could be a drum cooling a material being processed on the outer surface. The invention is applicable to any cylinder in which virtually the entire wall experiences an essentially uniform radial heat flow in either direction.

To counteract the stress components introduced by heat flow during operation, the drum wall of the present invention is thermally prestressed so as to leave residual stresses under no heat flow conditions that are opposite in direction to the stresses introduced by heat flow during operation. This is done by creating a heat flow through the drum wall adequate to cause a temperature differential across the wall sufficiently high as to induce stress levels beyond the yield point of the wall material. The strain will be greatest at the surfaces. In so yielding the surface zones will retain residual stresses when the heat flow is stopped. This mechanism will work only on a cylindrical shape. A cylinder is inherently self-constrained against changing shape to relieve the stresses caused by the heat flow and temperature differential. An unrestrained flat plate with such a temperature differential imposed surface-to-surface will simply bow or cup in response to the differential expansion through the thickness, thus remaining essentially stress free. The temperature creating the heat flow may not be so high as to anneal the metal of the cylinder. The continuous heat flow can be achieved by heating one surface of the wall and continually removing it from the other surface.

Assuming that the heat flow was from the inside of the wall to the outside, when the heat flow is stopped and the temperature differential removed, the previous yielding will leave the wall in a condition having a residual tension stress on the inside surface and a residual compression stress on the outside surface. The term "surface" is not intended to mean a zone encompassing only the literal "skin" of the drum but a zone including all of the wall thickness which exceeded the yield point stress. The residual stresses will be at maximum values at the literal surfaces.

The heat flow in normal operation will act to reduce the residual stresses. This leaves more of the stress capacity of the drum wall available to withstand mechanical loads. Alternatively, the drum wall is able to withstand a greater thermal flux and resulting temperature differential within the allowable design stress of the wall material.

It is an object of the present invention to provide a prestressed cylindrical structure that can handle higher temperature differentials across the cylinder wall and/or combinations of thermal and mechanical stresses.

It is another object to provide a drum for heating a material to be processed on the outside surface which has residual compression stresses at the outer surface and residual tension stresses at the inner surface under conditions of no heat flow.

It is also an object to provide a prestressed cylindrical structure having a stress gradient from compression to tension across the wall thickness, said stresses being essentially equal in value but opposite in sign at the respective wall surfaces.

It is a further object of the invention to provide a method for making a prestressed drum of the type noted.

These and many other objects will become readily apparent upon reading the following detailed description taken in conjunction with the drawings.

DETAILED DESCRIPTION OF THE PREFERRED EMBODIMENTS

Figure 5:
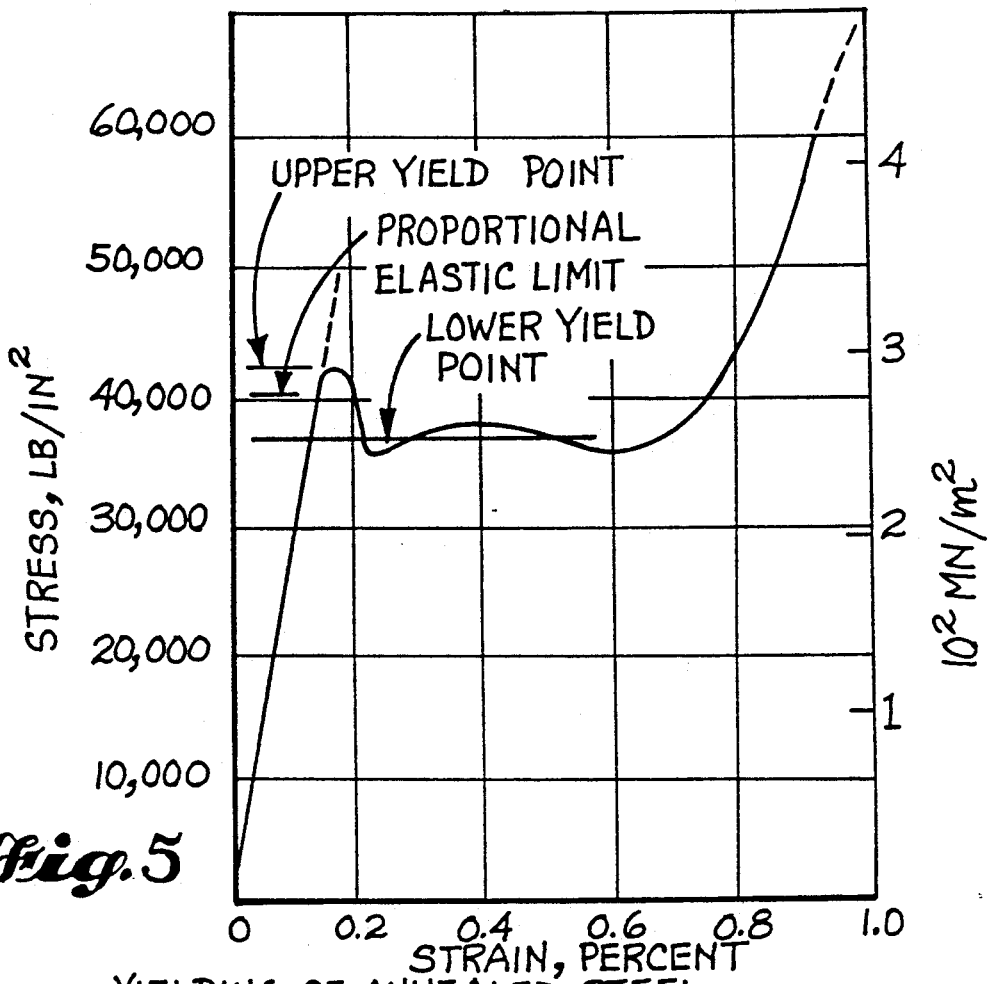
FIG. 5 is a typical stress-strain curve for steel.

The operation of the method can be better understood by reference to the drawings. FIG. 5 is a typical stress-strain diagram for annealed steel. This has been redrawn from an example in *Marks' Standard Handbook for Mechanical Engineers*, T. Baumeister et al., eds., 8th Ed., Mcgraw-Hill (1978). The curve shows that strain occurs elastically and linearly in response to stress up to the yield point. Beyond the yield point the metal yields plastically in response to further strain. As one example of a drum made with annealed steel, thermal prestressing equivalent to about 0.4% strain can be imposed to leave residual stresses somewhat below the yield point stress; i.e., equivalent to less than about 0.2% strain.

Figure 6:
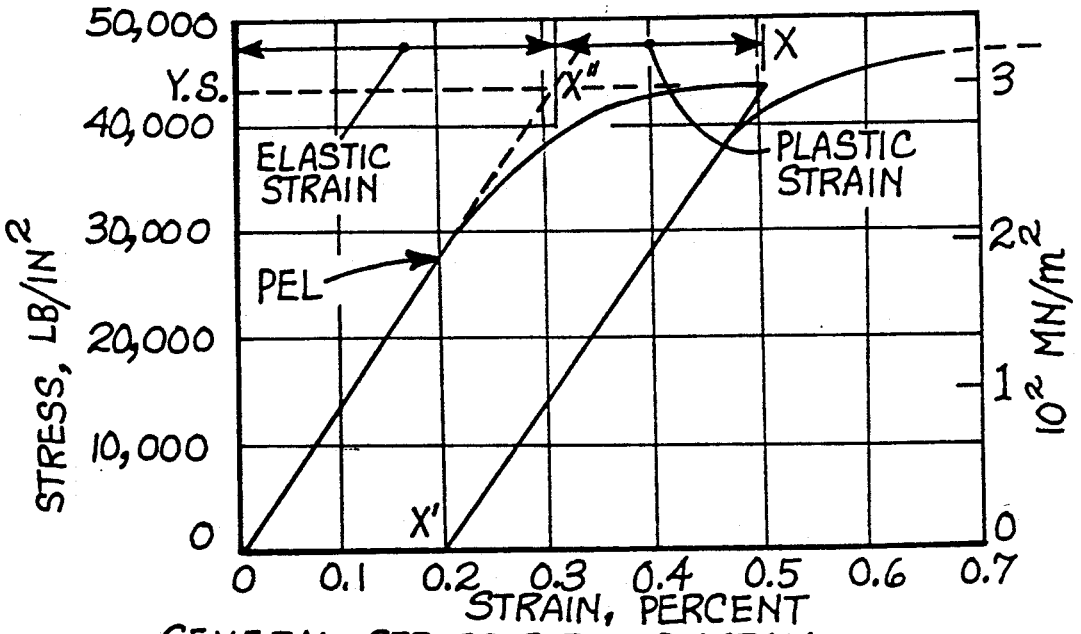
FIG. 6 is a general stress-strain diagram for steel that has once been stressed beyond its elastic limit.

FIG. 6 is redrawn from the same source as FIG. 5. This shows the stress-strain curve of a specimen strained beyond the yield point and then the stress removed. The test specimen returns to point x' with 0.2% residual plastic strain. The equivalent action occurs at the inner and outer surfaces of a thermally prestressed cylinder when the stress is removed. That is, when the heat flow is stopped and the temperature differential across the wall is removed, the residual plastic strain in the constrained cylinder wall creates residual stresses. These stresses are in the opposite direction from the stresses due to the heat flux.

Figure 7:
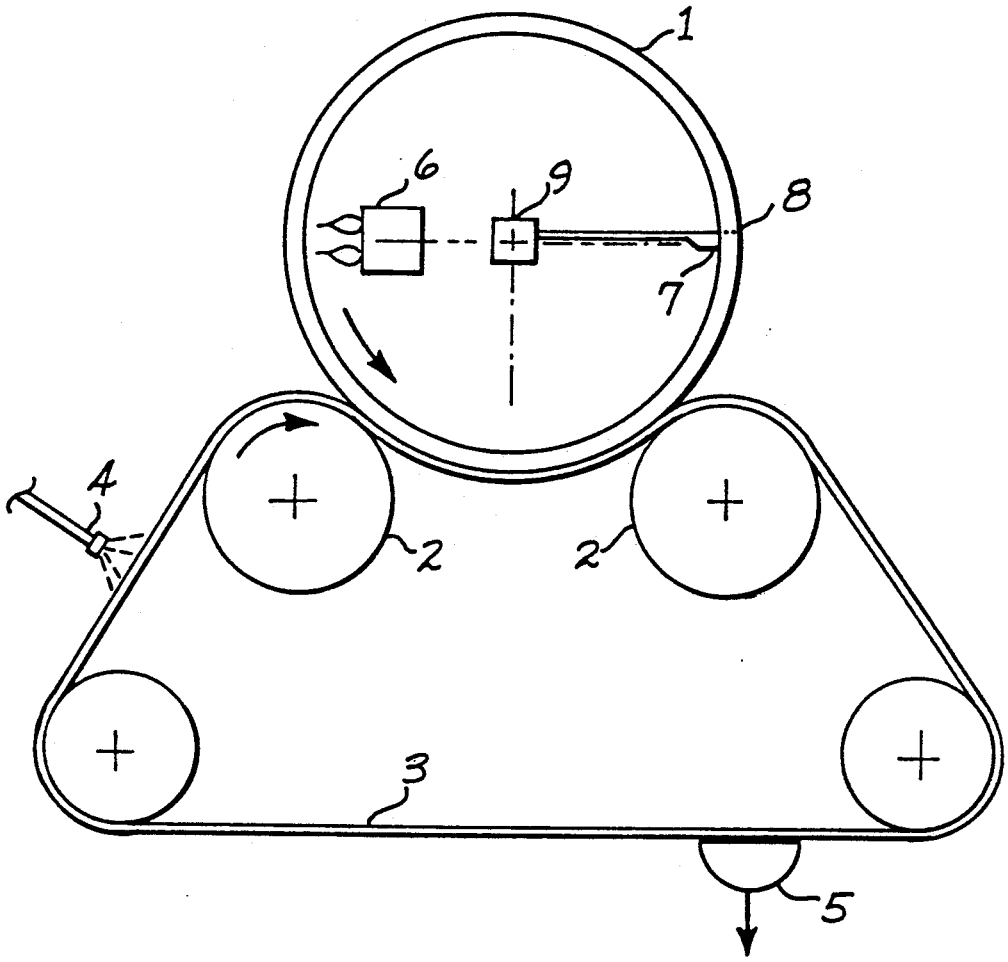
FIG. 7 shows schematically one configuration for thermally prestressing a cylinder.

FIG. 7 illustrates schematically one arrangement for performing thermal prestressing. The cylinder 1 to be treated is supported and rotated on bed rolls 2 and partially wrapped with a liquid saturated heat removal felt 3. A suitable cooling liquid supply 4 maintains the proper degree of saturation. A heat removal mechanism 5; e.g., a vacuum box, takes heat from the system. The heat supply 6 is a combustion flame; e.g., using natural gas or fuel oil. The thermal prestressing process is controlled in this case by thermocouples 7 and 8 mounted respectively at the inner and outer walls of the cylinder wall. A signal transmission means 9 associated with the thermocouples is used to control heat supply 6 and the heat removal means 3, 4, 5 to achieve the desired temperature differential across the cylinder wall.

Figure 8:
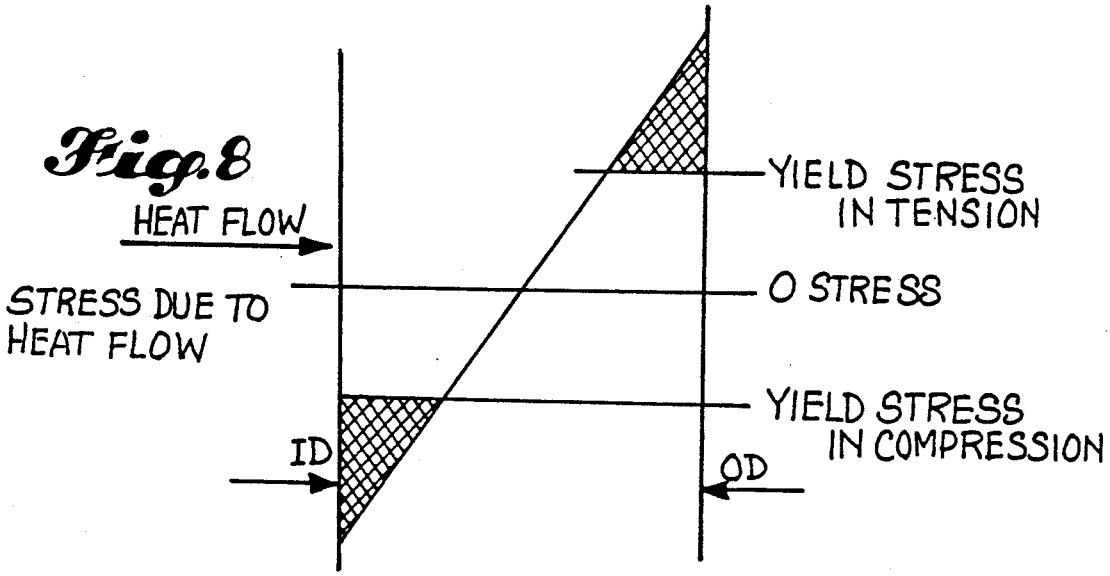
FIG. 8 shows the calculated stress pattern for a cylinder wall with heat flow creating stresses above the yield point.

FIG. 8 shows the stresses exerted on a cylinder of the present invention while subject to high unidirectional heat flow sufficient to create stresses beyond the yield point of the metal. It will be noted that these stresses are uniform and symmetrical across the thickness of the cylinder wall. The term "symmetrical" is used here in the context of being equal in magnitude but opposite in sign. The stress shown beyond the yield points is the computed stress before yielding. Since the entire surface of the cylinder is subject to the heat flow the stresses will be uniform at any point from end to end and similarly uniform around the full circumference.

Figure 9:
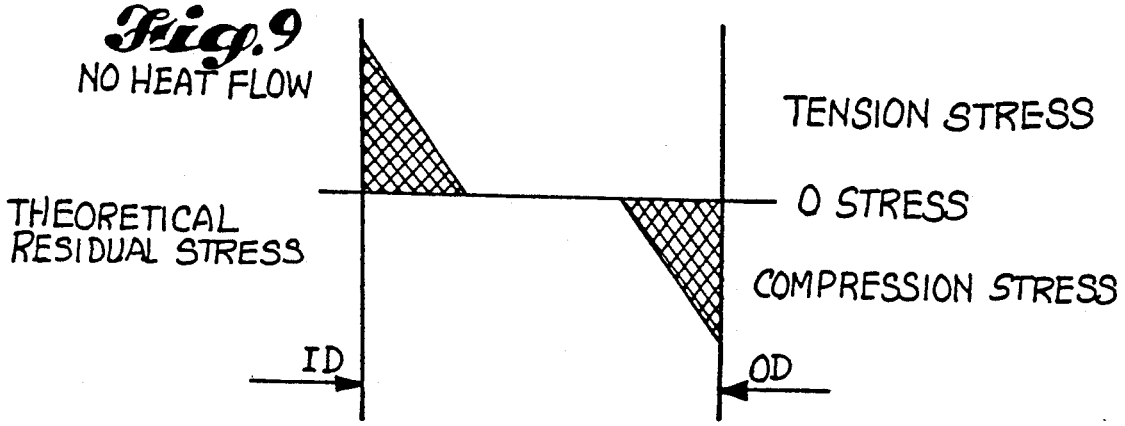
FIG. 9 shows the theoretical residual stress from FIG. 8

FIG. 9 shows the theoretical residual stress when the cylinder is returned to ambient temperature. These are opposite in sign (or direction) from those induced during the heat flow. In actuality the stresses will tend to naturally equalize across the thickness so that a residual stress pattern shown in FIG. 10 results. The stresses at the inner and outer surfaces are essentially equal in value but opposite in sign. This equalization is analogous to the equalization of stress across the cross section of a beam loaded above the yield point in bending (e.g., as described in the *Mechanical Engineer's Handbook*, 4th Ed., Lionel S. Marks ed., P 466, McGraw-Hill, New York 1941).

The nature of the residual stress pattern is a major advantage of the present invention. It inherently reduces the opposing stresses equally because it creates equal residual stresses opposite in direction to the operating thermal stresses. These residual stresses are equal but opposite at the two surfaces for two reasons. First, the overstressing mechanism of the invention is a controlled heat flow similar to the planned operational heat flow but sufficiently greater in magnitude so as to produce equal and opposite stresses above the yield point of the wall metal. Second, the yield point of most metals in compression and tension is the same, therefore producing equal and opposite residual stresses in the compression and tension zones.

Figure 1:
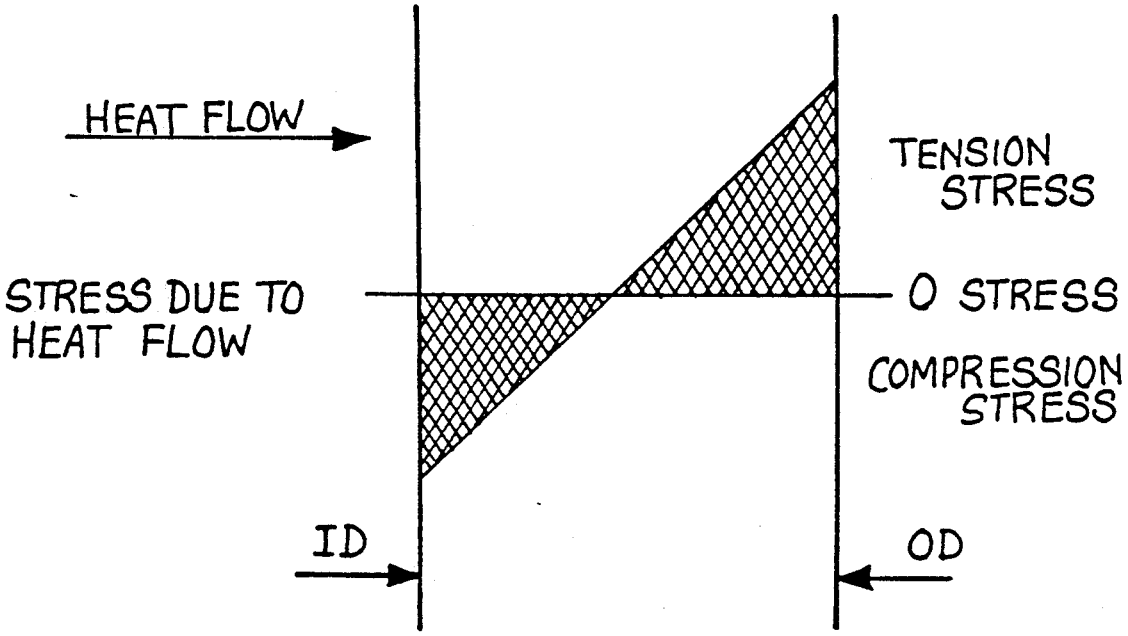
FIG. 1 shows the stress pattern for a cylinder wall with heat flowing through it.
Figure 2:
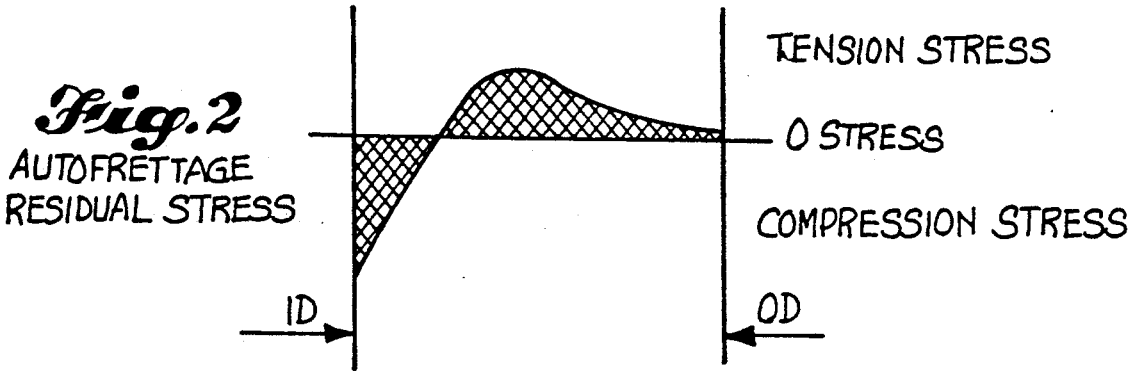
FIG. 2 shows the stress pattern created by autofrettage.
Figure 3:
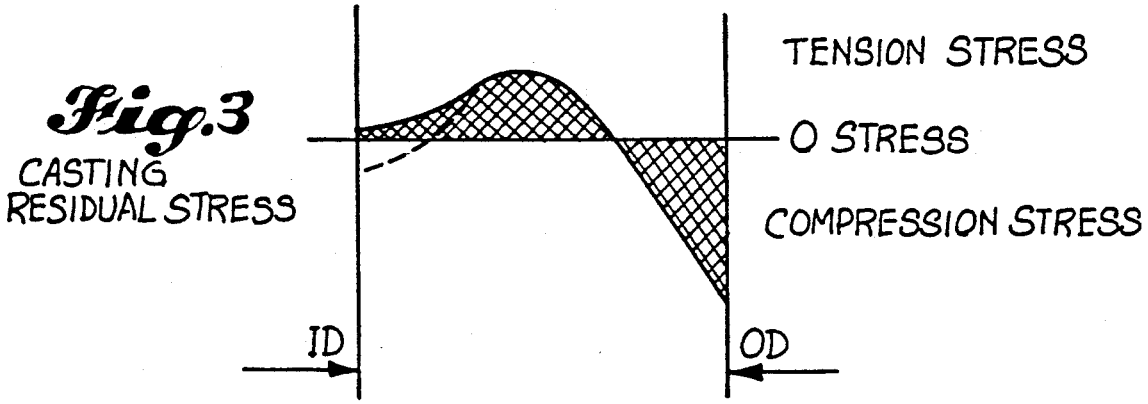
FIG. 3 shows typical casting residual stress patterns.
Figure 4:
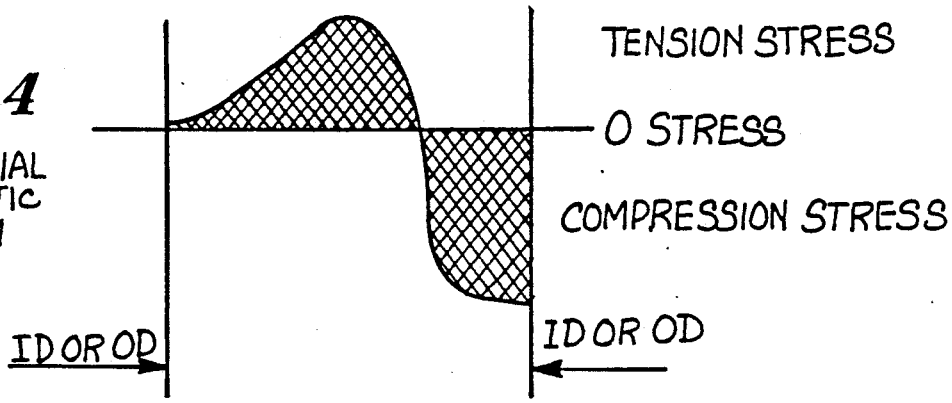
FIG. 4 shows the typical stress pattern produced by differential martensitic transition.
Figure 10:
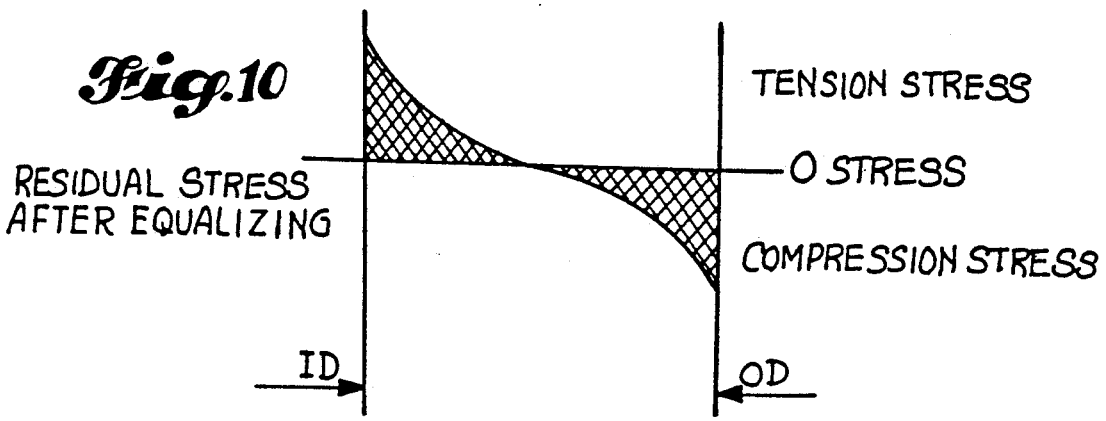
FIG. 10 shows the actual residual stress from the treatment of FIG. 8.

Reference to FIG. 10 shows that the stress pattern of the present invention is entirely different from that produced by any of the methods described in the background. Compared with the patterns of FIG. 2 (autofrettage), FIG. 3 (casting), and FIG. 4 (localized martensitic transition), it is readily seen that none of these create the desired uniform and symmetrical across-the-thickness stress pattern.

It is emphasized that the present method of prestressing is not a heat treatment process as these are conventionally understood. It is dependent solely on creating a temperature differential uniformly across the cylinder wall that is of sufficient magnitude to induce the necessary heat flow. The process is not dependent on some given absolute temperature level as is a conventional heat treatment. For example, it could be carried out with one wall surface of the cylinder at cryogenic temperatures and the other wall surface at whatever temperature was sufficient to create the necessary heat flow. Further, the prestressing is completely uniform over the entire surface of the cylinder, quite in contrast to that of the Japanese invention which uses a somewhat similar but quite localized heat flow mechanism. It is also quite in contrast to the localized induction heating of pipe welds for protection against stress corrosion cracking. A further difference is that the Japanese method produces a uniform stress across the wall thickness. There is no significant variation in stress level or sign from wall to wall.

Having thus disclosed the best mode presently known of making the present invention, it will be evident to those skilled in the art that many variations not disclosed herein can be made without departing from the spirit of the invention. It is the intent of the inventor that the invention should be limited only as it is defined in the following claims.

I claim:

1. A hollow metallic cylindrical structure for treating a material to be processed on one surface of the cylinder which comprises a cylinder wall having an inner surface and an outer surface, one of said surfaces being hotter than the other during operation, essentially the entire wall being prestressed so that under conditions of no heat flow through the wall, the surface to be the hotter operating surface during use is in residual tension and the other surface is in residual compression, said stresses at no heat flow conditions being opposite in direction to those induced by heat flow through the cylinder wall during operation, said stresses at the inner and outer surfaces being essentially equal in value but opposite in direction.

2. The cylinder of claim 1 in which at no heat flow conditions the outer surface has residual compression stresses and the inner surface has residual tension stresses, said cylinder being useful for heating a material being processed on the outer surface while applying heat to the inner surface.

3. A rotatable drum for heating a material on the outer surface of said drum which comprises a hollow metallic cylinder having a wall with an inner surface and an outer surface, one of said surfaces being hotter than the other during operation, essentially the entire cylinder wall being prestressed so that under conditions of no heat flow through the wall the inner surface, which will be the hotter operating surface during operation, is in residual tension and the outer surface is in residual compression, said stresses at no heat flow conditions being opposite in direction to those induced by heat flow through the cylinder wall during operation, said stresses at the inner and outer surfaces being essentially equal in value but opposite in direction.

4. A method for making a hollow metallic cylinder for heating or cooling a material to be processed, said cylinder having a wall with an inner surface and an outer surface, one of said surfaces being hotter than the other during operation, which comprises uniformly prestressing essentially the entire wall thereby leaving residual stresses in said wall at a condition of no heat flow through the wall, said residual stresses being tension stresses at the surface to be the hotter operating surface and compression stresses at the other surface, said residual stresses at no heat flow being opposite in direction to those induced by heat flow through the cylinder wall during operation, said stresses at the inner surface and outer surface being essentially equal in value but opposite in direction.

5. The method of claim 4, wherein said wall comprises a material with a predetermined yield point and in which said prestressing step comprises introducing the residual stresses by creating a continuous heat flow through the cylinder wall adequate to cause a temperature differential across the wall sufficient to induce stress levels beyond the yield point of the wall material.

6. The method of claim 5 in which said prestressing step comprises axially rotating said cylinder between a heat supply means adjacent one surface and a heat removal means adjacent the other surface so as to minimize surface temperature and residual stress variation around the entire cylinder wall during prestressing.

7. The method of claim 4 in which said prestressing step comprises introducing residual compression stresses at the outer surface and residual tension stresses at the inner surface of the cylinder wall under conditions of no heat flow through the wall, said cylinder being useful for heating a material to be processed on the outer surface while applying heat to the inner surface.

8. The method of claim 4 in which the heat flow is created by introducing heat at one wall surface and withdrawing heat at the other wall surface thereby creating an essentially uniform temperature gradient across the wall.

* * * * *